US005386170A

United States Patent [19]

Kogelschatz

[11] Patent Number: 5,386,170

[45] Date of Patent: Jan. 31, 1995

[54] HIGH-POWER RADIATOR

[75] Inventor: Ulrich Kogelschatz, Hausen, Switzerland

[73] Assignee: Heraeus Noblelight GmbH, Kleinostheim, Germany

[21] Appl. No.: 976,418

[22] Filed: Nov. 13, 1992

[30] Foreign Application Priority Data

Dec. 9, 1991 [DE] Germany ..... 4140497

[51] Int. Cl.[6] ..... H01J 7/24; H01J 61/52

[52] U.S. Cl. ..... 313/17; 313/21; 313/23; 313/607

[58] Field of Search ..... 313/17, 18, 21, 22, 313/23, 607

[56] References Cited

U.S. PATENT DOCUMENTS 5,198,717 3/1993 Kogelschatz et al. ..... 313/17

FOREIGN PATENT DOCUMENTS 0031175 7/1981 European Pat. Off. .
0254111 1/1988 European Pat. Off. .
0385205 9/1990 European Pat. Off. .
613178 5/1935 Germany .
2438372 2/1976 Germany .
3323637 1/1984 Germany .

*Primary Examiner*—Sandra L. O'Shea
*Attorney, Agent, or Firm*—Oblon, Spivak, McClelland, Maier, & Neustadt

[57] ABSTRACT

An additional capacitance in the form of a molding (12″) composed of dielectric material is inserted in an inner space of an ultraviolet light excimer radiator, making it possible to enforce loss-free control of the axial and/or radial distribution of the power consumption and ultraviolet light intensity. In the irradiation of wide substrates such as sheets, papers, and the like coated with paint, lacquers or adhesives, in particular, this measure is advantageous if all the regions of the substrate are to be irradiated with approximately the same dose.

11 Claims, 4 Drawing Sheets

HIGH-POWER RADIATOR

BACKGROUND OF THE INVENTION

1. Field of the Invention

The invention relates to a high-power radiator, in particular for ultraviolet light, having a discharge chamber filled with a filling gas which emits radiation under discharge conditions, the walls of said chamber being formed by an external and an internal dielectric and the outer surfaces of the external dielectric being provided with first electrodes, having second electrodes on the surface of the second dielectric remote from the discharge chamber, and having an alternating current source connected to the first and second electrodes for feeding the discharge.

In this connection, the invention proceeds from prior art such as is disclosed, for instance, by EP-A 254 111, U.S. patent application Ser. No. 07/485,544 dated Feb. 27, 1990 or, alternatively, by European Patent Application 90103082.5 dated Feb. 17, 1990.

2. Discussion of Background

The industrial use of photochemical processes is very dependent on the availability of suitable UV sources. The conventional UV radiators provide low to medium UV intensities at a few discreet wavelengths such as, for example, the mercury low-pressure lamps at 185 nm and in particular at 254 nm. Really high UV powers are obtained only from high-pressure lamps (Xe, Hg), but these then distribute their radiation over a larger wavelength range. The new excimer lasers have made a few new wavelengths available for fundamental photochemical experiments, but they are probably suitable at present for an industrial process only in exceptional cases for cost reasons.

The European patent application mentioned at the outset or, alternatively, the conference publication entitled "Noble UV and VUV excimer radiators" by U. Kogelschatz and B. Eliasson, distributed at the 10th Lecture Meeting of the Society of German Chemists, Specialist Group on Photochemistry in Würzburg (BRD) on 18–20 Nov. 1987 describe a noble excimer radiator. This noble radiator type is based on the principle that excimer radiation can be generated even in dark electrical discharges, a type of discharge which is used on a commercial scale in the generation of ozone. In the current filaments of this discharge, which are present only for a short time (<1 microsecond), noble gas atoms are excited by electron collision which react further to form excited molecular complexes (excimers). Said excimers live only a few 100 nanoseconds and give up their bonding energy in the form of UV radiation upon decomposing.

The high-power radiators mentioned are remarkable for high efficiency and economical construction, and make it possible to produce large radiators such as those used in UV polymerization and sterilization. In this connection, wide conveyor belts or conveyor cylinders often have to be irradiated by rod-type UV radiators. Typically, sheets, papers, cardboards, lengths of fabric, etc. coated with paints, lacquers or adhesives are irradiated by UV lamps approximately one meter long. Since the intensity of the lamps is normally distributed uniformly over the length, the peripheral zones of the substrate naturally receive a lower radiation dose. In order to obtain a dose sufficient for the process even at the periphery, the radiators have to remain substantially longer than the width of the substrate. This is usually out of the question in conveyor belt installations for design reasons. The other possibility is to increase the intensity of the lamps to such an extent that the dose is just sufficient at the periphery. Consequently, a substantial swamping of the central zones with light is acceded to, with a corresponding energy consumption.

SUMMARY OF THE INVENTION

Accordingly, proceeding from the prior art, one object of the invention is to provide a novel high-power radiator in particular for UV or VUV radiation, which is remarkable, in particular, for high efficiency, is economical to manufacture and in which the radiation can be radiated in a controlled manner. In particular, the proposed radiator should make it possible to expose planar substrates homogeneously.

To achieve said object, according to the invention, the high-power radiator of the generic type mentioned in the introduction is one wherein, to modify the radiation characteristic of the radiator, means are provided for locally altering the operating voltage of the discharge and/or the effective capacitance of the dielectric and the second electrode is coupled to the discharge chamber essentially via a liquid having a permittivity which is at least a factor of 10 higher than the permittivity of the dielectric, which liquid simultaneously serves to cool the radiator.

The invention makes it possible for the first time to produce UV radiators whose intensity is nonuniformly distributed over the length and is slightly raised at the ends.

The embodiments of the invention and the advantages achievable therewith are explained in greater detail below by reference to the drawing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
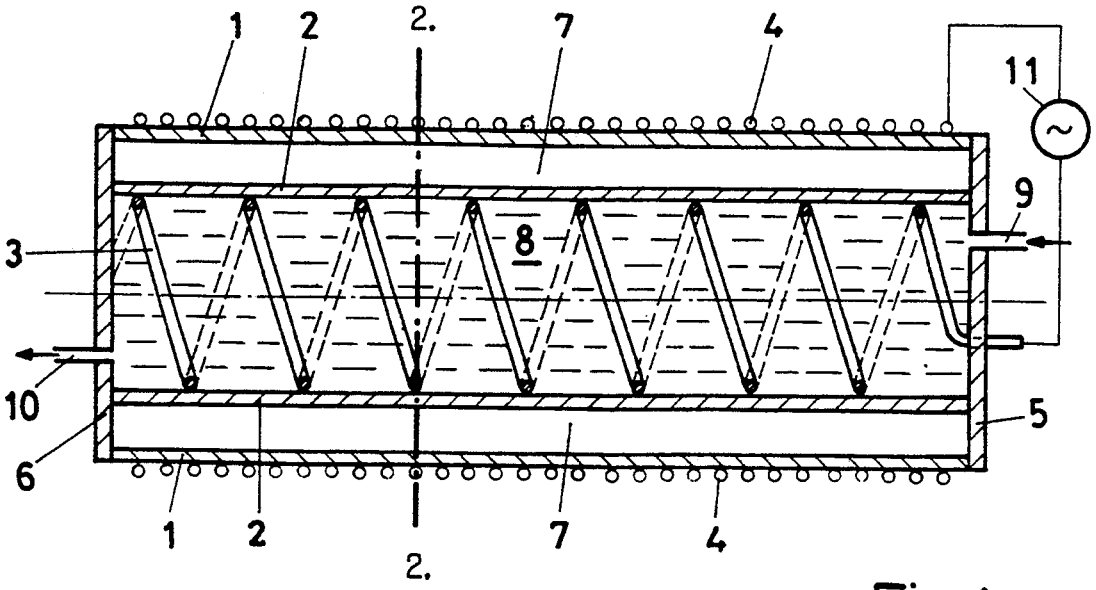
FIG. 1 shows a UV cylindrical radiator having a concentric arrangement of the internal dielectric tube in longitudinal section.
Figure 2:
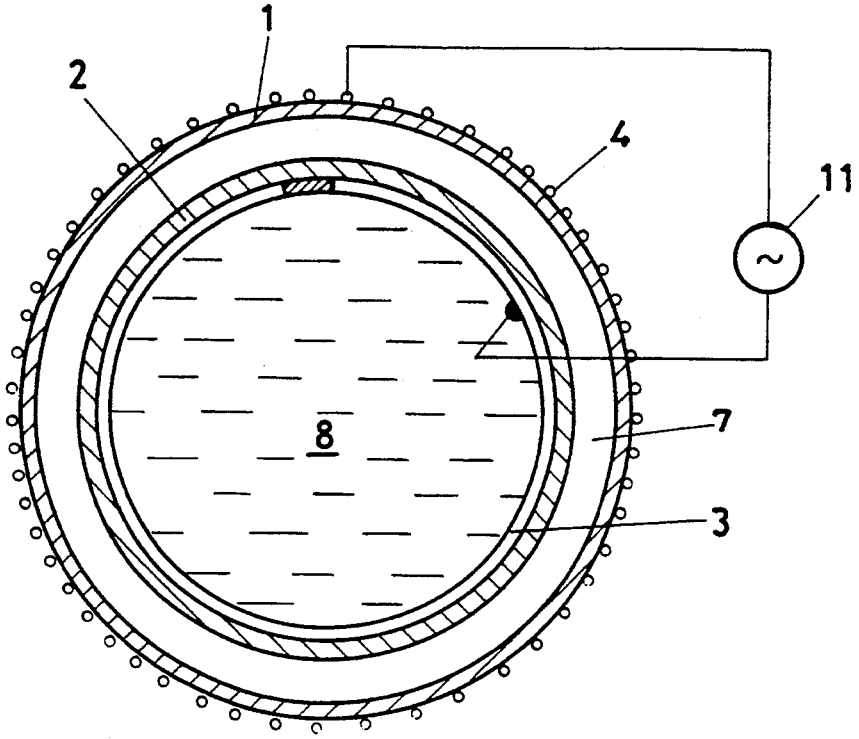
FIG. 2 shows a section through the UV radiator shown in FIG. 1 along the line AA therein.

Referring now to the drawings, wherein like reference numerals designate identical or corresponding parts throughout the several views, the starting point in relation to the invention to be described below is an excimer radiator as shown in FIGS. 1 and 2. Arranged coaxially in an external quartz tube 1 having a wall thickness of about 0.5 to 1.5 mm and an outer diameter of about 20 to 30 mm is an internal quartz tube 2. Resting against the inner surface of the internal quartz tube 2 is a helical inner electrode 3.

An outer electrode 4 in the form of a wire net extends over the entire outer circumference of the external quartz tube 1.

A wire 3 is pushed into the internal quartz tube 2. This forms the inner electrode of the radiator, while the wire net 4 forms the outer electrode of the radiator. The quartz tubes 1 and 2 are sealed or closed by fusion at both ends by a cover 5 or 6 in each case. The space between the two tubes 1 and 2, the discharge chamber 7, is filled with a gas/gas mixture which emits radiation under discharge conditions. The interior 8 of the internal quartz tube 2 is filled with a liquid having a high permittivity, preferably demineralized water ($\ddot{Y}=81$). This liquid serves simultaneously to cool the radiator. The cooling liquid is supplied and removed via the connections 9 and 10, respectively. As is explained later in still greater detail in the case of the designs with a central inner electrode, the cooling liquid serves to couple the inner electrode 3 electrically to the internal quartz tube 2, with the result that it is not necessary for the helical electrode 3 to rest against the inner wall at every point.

The two electrodes 3, 4 are connected to the two terminals of an alternating current source 11. The alternating current source delivers an adjustable alternating voltage in the order of magnitude of several 100 volts to 20000 volts at frequencies in the range of industrial alternating current up to a few thousand kHz, depending on the electrode geometry, pressure in the discharge chamber and composition of the filling gas.

The filling gas is, for example, mercury, noble gas, noble gas/metal vapor mixture, noble gas/halogen mixture, optionally with the use of an additional further noble gas, preferably Ar, He, Ne, as buffer gas.

In this connection, depending on the desired spectral composition of the radiation, a substance/substance mixture in accordance with the following table may be used:

| Filling gas | Radiation |
|---|---|
| Helium | 60–100 nm |
| Neon | 80–90 nm |
| Argon | 107–165 nm |
| Argon + fluorine | 180–200 nm |
| Argon + chlorine | 165–190 nm |
| Argon + krypton + chlorine | 165–190, 200–240 nm |
| Xenon | 160–190 nm |
| Nitrogen | 337–415 nm |
| Krypton | 124, 140–160 nm |
| Krypton + fluorine | 240–255 nm |
| Krypton + chlorine | 200–240 nm |
| Mercury | 185, 254, 320–370, 390–420 nm |
| Selenium | 196, 204, 206 nm |
| Deuterium | 150–250 nm |
| Xenon + fluorine | 340–360 nm, 400–550 nm |
| Xenon + chlorine | 300–320 nm |

In addition, a number of further filling gases are suitable:

- a noble gas (Ar, He, Kr, Ne, Xe) or Hg with a gas or vapor selected from the group comprising $F_2$, $J_2$, $Br_2$, $Cl_2$ or a compound which releases one or more F, J, Br or Cl atoms in the discharge;
- a noble gas (Ar, He, Kr, Ne, Xe) or Hg with $O_2$ or a compound which releases one or more O atoms in the discharge;
- a noble gas (Ar, He, Kr, Ne, Xe) with Hg.

On applying an alternating voltage between the electrodes 3 and 4, a multiplicity of discharge channels (partial discharges) are formed in the discharge chamber 7. These interact with the atoms/molecules of the filling gas, which ultimately results in UV or VUV radiation.

In the dark electric discharge (silent discharge) which forms, the electron energy distribution can be optimized by the thickness of the dielectrics and its pressure and/or temperature properties in the discharge chamber.

For a cylindrical radiator as shown in FIGS. 1 or 2, the power consumption of a dark electric discharge is described by the following formula:

$$P=4\,f\,C_D\,U_B\,(\hat{U}-(1+\beta)U_B) \qquad (1)$$

where f is the frequency of the supply voltage, $C_D$ is the capacitance of the dielectric, $U_B$ is the mean operating voltage of the gas discharge and $\beta$ is the capacitance ratio discharge gap capacitance/dielectric capacitance ($C_S/C_D$).

With a fixed voltage supply (frequency f and peak voltage U fixed), the power consumption can therefore be modified by altering the operating voltage $U_B$ and/or the capacitance of the dielectric $C_D$. If these variables are altered only locally, the power consumption and, consequently the UV intensity can be modified in a controlled manner along a tube and/or in the circumferential direction of the tube.

In a sealed discharge tube, for example as shown in FIG. 1, the pressure and the gas composition is the same at every point. Since the operating voltage in the pressure range of interest is a monotonic, approximately linear function of the gap width, the power can be controlled by varying the width of the discharge gap. In this connection, a distinction should be made between two operating states of the discharge: the power depends (for fixed f and U) quadratically on $U_B$ (cf. equation (1)). The maximum power is consumed if $$U_B = \hat{U}/(2(1+\beta)) \quad (2)$$

(maximum of the power parabola).

Figure 3:
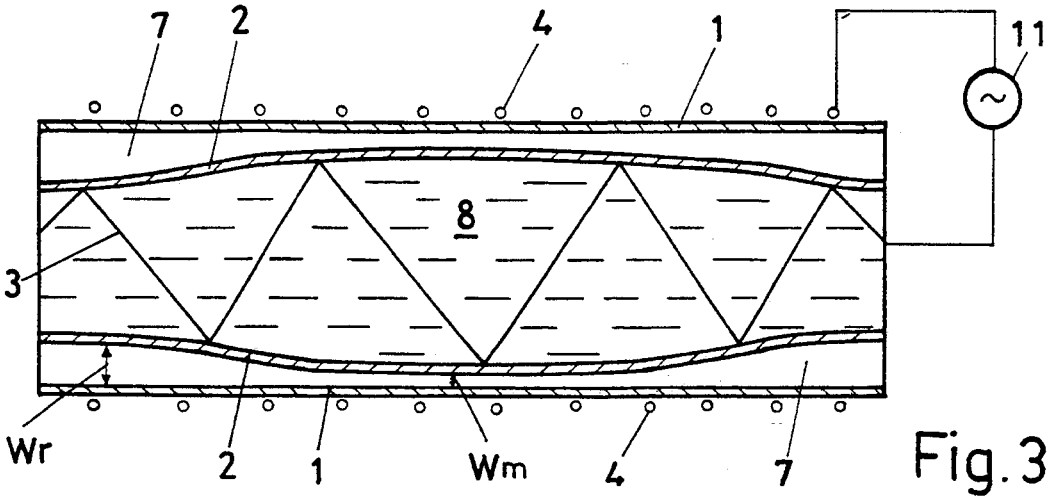
FIG. 3 shows an embodiment of the radiator according to the invention having a discharge chamber whose gap width is smaller in the central region than in the peripheral region.

If $U_B$ is smaller than this value, an increase in gap width results in an increased power consumption (FIG. 3). If $U_B$ is greater than the value defined in (2), a decrease in the gap width results in an increased power consumption (FIG. 4).

Figure 4:
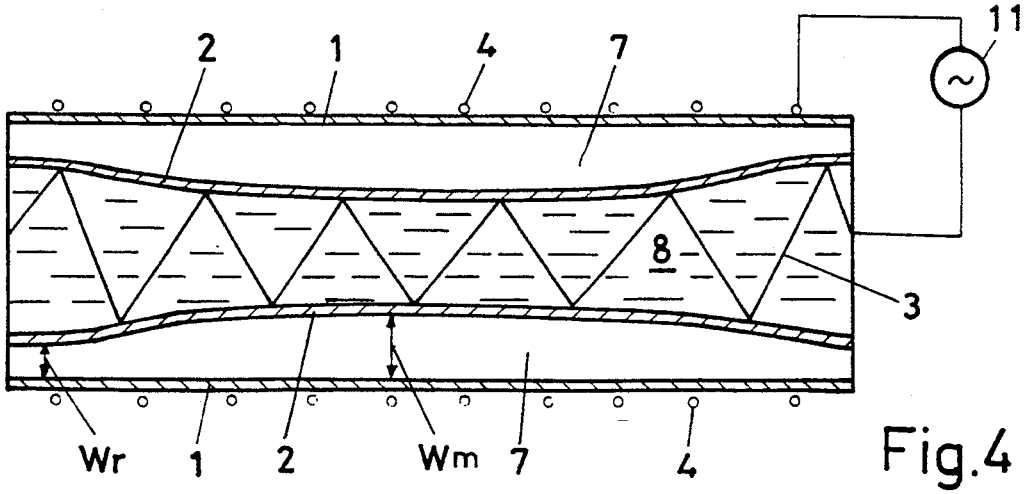
FIG. 4 shows an embodiment of an irradiation device analogous to FIG. 3, but having a discharge chamber whose gap width is larger in the central region than in the peripheral region.

The application of this insight to a radiator as shown in FIG. 1 results in embodiments such as those shown in simplified form in FIGS. 3 and 4. In this connection, as explained above, two alternatives are possible, depending on how the operating voltage is situated with respect to the maximum of the power parabola. In order to increase the intensity in the peripheral zones in a radiator as shown in FIG. 1 so that the dose is sufficient in this region, the gap width $w_m$ in the central portion is smaller than the gap width $w_r$ in the peripheral zone (FIG. 3), or vice versa (FIG. 4).

The power consumed can also be increased by an increase in the capacitance of the dielectric (cf. equation (1)). This can be achieved by reducing the wall thickness of the internal and external quartz tube 2 and 1, respectively, in the peripheral zones, or by doping the quartz with substances such as $TiO_2$ or $BaTiO_3$.

The hitherto cited possibilities for varying the power consumption in the longitudinal direction of the radiator tend to be structurally very expensive. It is substantially simpler and more economical to fit an additional capacitance between the two electrodes 3 and 4, as is shown diagrammatically in FIG. 5.

Figure 5:
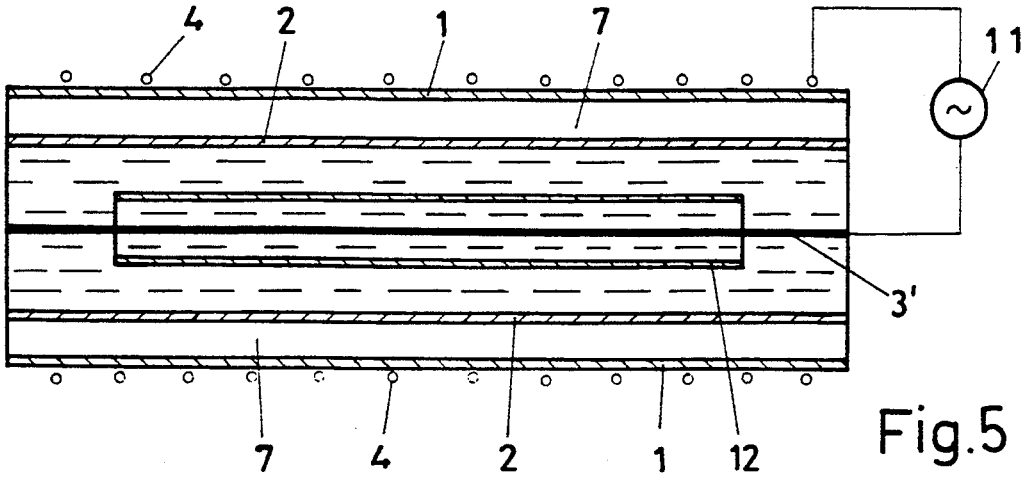
FIG. 5 shows an embodiment having an additional capacitance in the form of a dielectric tube in the interior of the internal dielectric tube.
Figure 6:
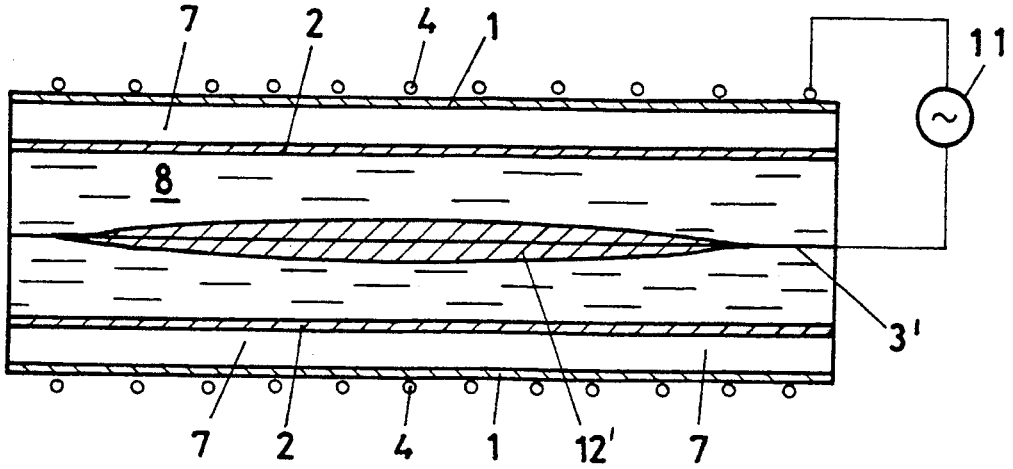
FIG. 6 shows an embodiment having an additional capacitance in the form of a molding surrounding the central inner electrode.

Unlike the radiators shown in FIGS. 1 to 4, the radiator shown in FIG. 5 has a central electrode 3' over which a dielectric tube 12, which acts as additional capacitance, has been pushed. Its inner diameter is greater than the outer diameter of the central electrode 3'. The length of said tube 12 is smaller than that of the external and internal dielectric tubes 1 and 2, respectively. Because said additional capacitance is connected (electrically) in series with the capacitances of the internal and external dielectric tube, the effective capacitance of the dielectric $C_D$ in the central part of the radiator decreases. This results automatically in a lower power consumption in the center of the radiator. The axial intensity profile can therefore be controlled by the wall thickness and the length of the tube 12 and, consequently, the dose applied to the substrate can be largely homogenized. The intensity profile can be controlled still more accurately if a molding made of dielectric material and having a continuous transition is installed, as is shown in FIG. 6. Said molding 12' surrounds the central inner electrode 3' completely and tapers to a point at the periphery. It is composed of a dielectric, readily machinable material, for example of PTFE ($\ddot{Y}=2.2$), polyimide ($\ddot{Y}=3.5$) or nylon ($\ddot{Y}=3.75$).

A common feature of the designs shown in FIGS. 5 and 6 is that the central internal electrode 3' is coupled to the internal quartz tube 2 (and, consequently, to the discharge chamber 7) not directly, but via the liquid, preferably demineralized water, filling the inner space 8 of the internal quartz tube 9. Because of the high permittivity of water ($\ddot{Y}=81$), the effective increase in the capacitance of the dielectric $C_D$ is in fact essentially modified only by the molding 12' and scarcely by the water.

Figure 7:
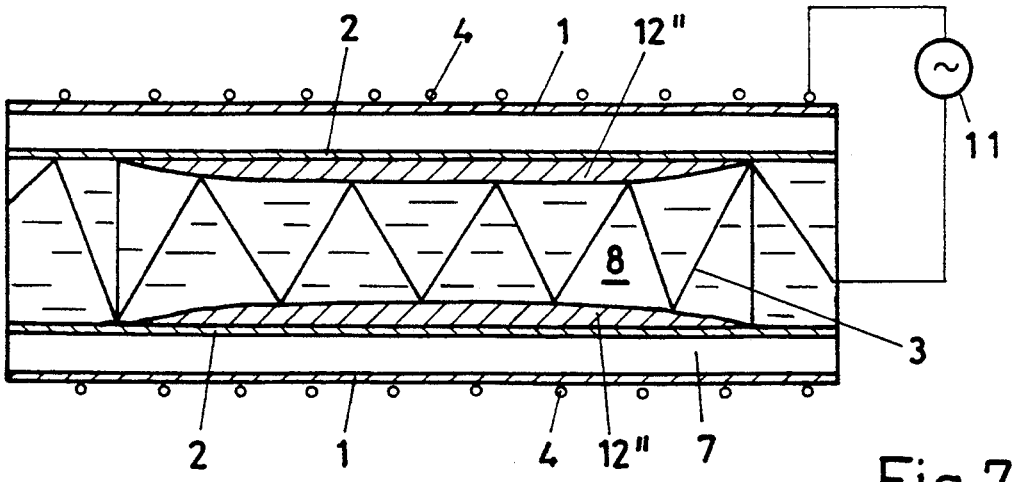
FIG. 7 shows an embodiment having an additional capacitance in the form of a molding which fits closely to the inner wall of the internal dielectric tube.

Instead of a molding surrounding the central inner electrode 3' and supported by the latter, a tubular molding 12'' may be mounted on the inner wall of the internal quartz tube 2, which molding is tapered towards its two ends in a similar way to that shown in FIG. 6, as emerges from FIG. 7. In an analogous way to the designs shown in FIGS. 1 to 4, use is made here of a helical electrode 3 which rests against the inner wall of the molding 12'' in the central portion and against the quartz tube 2 in the peripheral zone.

Without departing from the scope of the invention, the control of the axial power and intensity described above can also be used for the radial control of the power consumed and, consequently, of the UV intensity.

Figure 8:
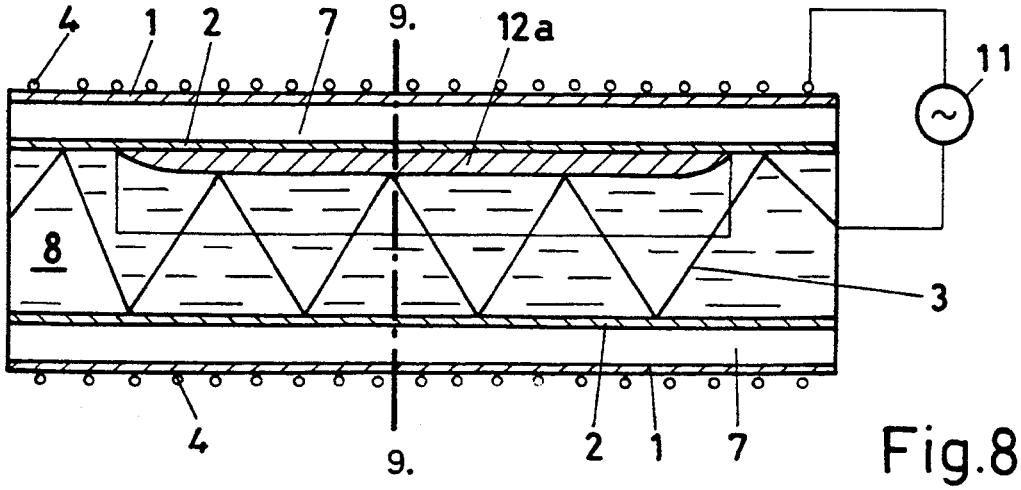
FIG. 8 shows an embodiment having an additional capacitance in the form of a molding having a sickle-shaped cross section which extends in the circumferential direction only over half of the inner circumference of the internal dielectric tube.
Figure 9:
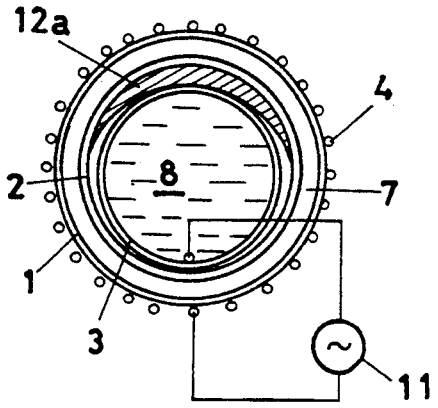
FIG. 9 shows a section through the radiator shown in FIG. 8 along line BB therein.
Figure 10:
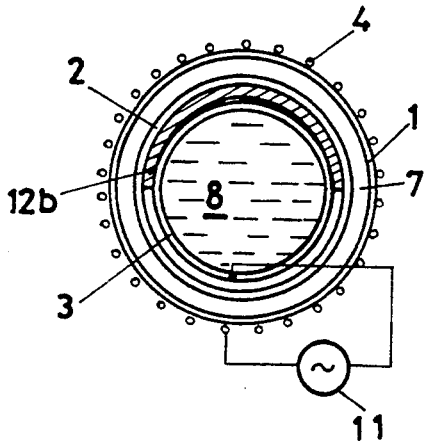
FIG. 10 shows a modification of the embodiment shown in the FIGS. 8 and 9 having an additional capacitance in the form of a dielectric half-tube which extends only over half the internal circumference of the internal dielectric tube.

As shown in FIGS. 8 and 9, a molding 12*a* having a sickle-shaped cross section and composed of a dielectric material extends only over the upper half of the inner circumference of the internal quartz tube 2 (FIG. 9). In longitudinal section, it resembles the molding 12'' of FIG. 7, i.e. it tapers to a point at both ends before reaching the peripheral region of the radiator. An equivalent solution using a half-tube 12*b* composed of dielectric material without a tapering peripheral zone is shown in section in FIG. 10. In both versions, a helical inner electrode 3 is used.

Figure 11:
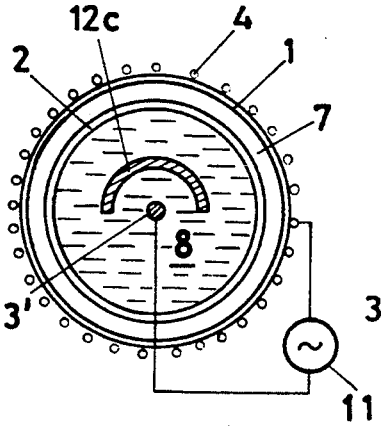
FIG. 11 shows a modification of the embodiment shown in FIG. 5 having a central electrode and an additional capacitance in the form of a dielectric half-tube in the space between inner electrode and internal dielectric tube.
Figure 12:
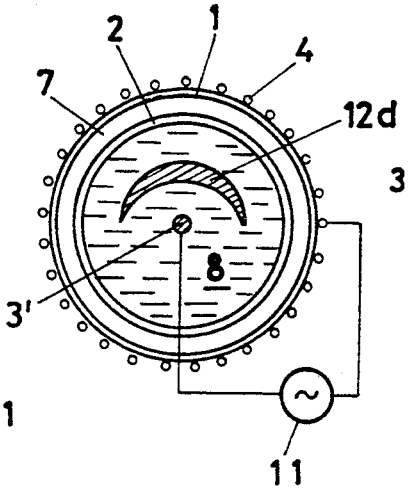
FIG. 12 shows a further modification of the embodiment shown in FIG. 5 having a central electrode and an additional capacitance in the form of a dielectric molding having a sickle-shaped cross section in the space between inner electrode and internal dielectric tube.
Figure 13:
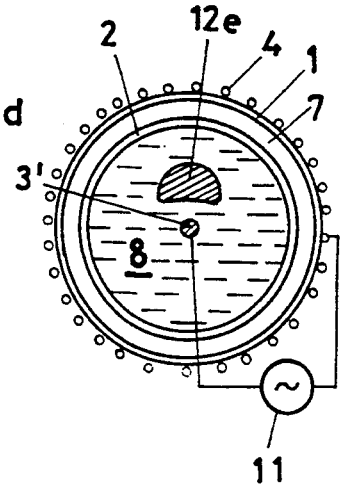
FIG. 13 shows a further modification of the embodiment shown in FIG. 5 having a central electrode and an additional capacitance in the form of a dielectric molding having a kidney-shaped cross section in the space between inner electrode and internal dielectric tube.

In an analogous way to the designs shown in FIGS. 5 and 6 and having a central inner electrode 3', moldings composed of dielectric material can be fitted in the inner space 8 of the internal quartz tube 2, which moldings only partially surround said electrode. Thus, a half-tube 12*c* composed of dielectric material is arranged in the upper portion of the inner space 8 of FIG. 11, a molding 12*d* having a sickle-shaped cross section in FIG. 12 and a molding 12*e* with kidney-shaped cross section in FIG. 13. All these additional capacitances 12*a* to 12*e* reduce the power consumption in the upper portion of the discharge chamber 7, effect an increased power consumption in the lower portion of the discharge chamber 7 and, consequently, enforce a directional radiation downwards.

As FIGS. 8 and 9 illustrate, control of the radial and axial power and intensity can readily be combined in one radiator. Incidentally, this applies even to the radiator arrangements as shown in FIGS. 3 and 4. Depending on the operating voltage $U_B$, it is possible even in those cases to shape the internal quartz tube 2 in such a way that the gap width is the same at every point in the axial direction in the lower half, whereas it is larger or smaller, respectively, than in the peripheral zone in the central portion of the upper half.

From the exemplary embodiments it is furthermore obvious that the measures in accordance with the invention for controlling the power and intensity can also readily be applied retrospectively in existing radiators, with the result that, in mass-produced radiators, a loss-free control of the axial and/or radial distribution of the power consumption and UV intensity can be enforced by inserting an additional molding in the internal cooling circuit.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-power ultraviolet light radiator comprising:

a hollow cylindrical discharge chamber filled with a filling gas which emits radiation under discharge conditions, walls of said discharge chamber being formed by an internal dielectric and an external dielectric;

a first electrode provided on an outer surface of said external dielectric;

a second electrode provided on an inner surface of said internal dielectric such that said second electrode does not lie within said discharge chamber;

an alternating current source connected to said first and second electrodes for feeding a discharge; and means for modifying a radiation characteristic of said high power ultraviolet light radiator in a direction along a longitudinal axis of said discharge chamber by varying a gap width thereof which locally alters an operating voltage of said discharge, or by varying an effective capacitance of said dielectrics in a direction of said longitudinal axis, and for modifying a radiation characteristic of said high power ultraviolet light radiator in a radial direction of said discharge chamber by varying said effective capacitance of said dielectrics in a direction perpendicular to said longitudinal axis, wherein said second electrode is effectively coupled to said discharge chamber via a liquid which surrounds said second electrode and has a permittivity which is greater than a permittivity of said dielectrics by at least a factor of 10 and simultaneously serves to cool said high power ultraviolet light radiator.

2. A high power radiator according to claim 1, wherein said liquid is water having a permittivity of approximately $\dot{Y}=80$.

3. A high power radiator according to any of claims 1 or 2, wherein said gap width of said discharge chamber at a central portion of said radiator is different from a gap width at a peripheral zone of said radiator.

4. A high power radiator according to claim 1, wherein said gap width of said discharge chamber in an upper half of said radiator is different from said gap width in a lower half of said radiator.

5. A high power radiator according to any of claims 1 or 2, wherein an additional capacitance is provided between said second electrode and said internal dielectric, said additional capacitance being constructed of a molding composed of dielectric material which extends substantially over a central portion of said radiator or solely over a portion of a circumference of said radiator.

6. A high power radiator according to claim 5, wherein said second electrode comprises a central electrode, and wherein said molding comprises a quartz tube which surrounds said central electrode.

7. A high power radiator according to claim 5, wherein said second electrode comprises a central electrode, and wherein said molding surrounds said central electrode and tapers to a point toward a lateral periphery of said radiator.

8. A high power radiator according to claim 5, wherein said additional capacitance is constructed as a molding which is formed against said inner surface of said internal dielectric, and wherein said first electrode is formed against said molding.

9. A high power radiator according to claim 8, wherein said molding tapers to a point toward a lateral periphery of said radiator.

10. A high power radiator according to claim 8, wherein said molding has a sickle-shaped cross section and extends only over a portion of a circumference of said internal dielectric.

11. A high power radiator according to claim 5, wherein said first electrode comprises a central electrode, and wherein said molding having a half-tubular, sickle-shaped, or kidney-shaped cross section and composed of dielectric material is provided between said central electrode and said internal dielectric and is spaced apart from said internal dielectric.

* * * * *